US005736997A

United States Patent [19]

Bolash et al.

[11] Patent Number: 5,736,997

[45] Date of Patent: Apr. 7, 1998

[54] THERMAL INK JET PRINTHEAD DRIVER OVERCURRENT PROTECTION SCHEME

[75] Inventors: John Philip Bolash; Mark Joseph Edwards, both of Lexington, Ky.

[73] Assignee: Lexmark International, Inc., Lexington, Ky.

[21] Appl. No.: 639,385

[22] Filed: Apr. 29, 1996

[51] Int. Cl.[6] ..... B41J 29/393

[52] U.S. Cl. ..... 347/19

[58] Field of Search ..... 347/9, 6, 10, 17, 347/14, 19, 67; 400/124.02; 361/212, 18, 93

[56] References Cited

U.S. PATENT DOCUMENTS

| | | | |
|---|---|---|---|
| 4,119,973 | 10/1978 | Stager . | |
| 4,171,527 | 10/1979 | Osborne et al. . | |
| 4,290,116 | 9/1981 | Morse . | |
| 4,375,339 | 3/1983 | Dyer et al. | 400/249 |
| 4,439,776 | 3/1984 | Zeiler . | |
| 4,667,117 | 5/1987 | Nebgen et al. | 307/154 |
| 4,768,045 | 8/1988 | Koto | 347/19 |
| 4,825,102 | 4/1989 | Iwasawa et al. | 307/296.5 |
| 4,838,157 | 6/1989 | Signore, II | 101/93.03 |
| 4,841,313 | 6/1989 | Weiner . | |
| 4,848,943 | 7/1989 | Sutcliffe | 400/124 |
| 5,164,747 | 11/1992 | Osada et al. . | |
| 5,182,580 | 1/1993 | Ikeda et al. . | |
| 5,206,668 | 4/1993 | Lo et al. . | |
| 5,319,389 | 6/1994 | Ikeda et al. . | |
| 5,381,099 | 1/1995 | Balousek | 324/555 |
| 5,428,498 | 6/1995 | Hawkins et al. | 361/212 |
| 5,432,665 | 7/1995 | Hopkins | 361/18 |

*Primary Examiner*—Edward Tso
*Attorney, Agent, or Firm*—Ronald K. Aust

[57] ABSTRACT

A method and apparatus is provided for detection of low to moderate impedance short circuits on any driven line of a thermal ink jet printer to inhibit damage to printer driver circuitry, principally active elements thereof. The printer includes a printhead having a plurality of thermally activated print nozzles therein for ink ejection upon thermal agitation of the ink within the nozzle, and data and address drive lines driven by data line and address line drivers for selection and activation of nozzle heater active elements associated with each of the nozzles by effecting current flow through a heater element associated with each of said nozzles upon selection by associated address and data line activation. One method includes the steps of energizing one of a data line and address lines associated with at least one thermal ink jet nozzle on the printhead, detecting a lower than normal impedance on the energized line, and inhibiting further activation or energization of at least one of the data and address line drivers. The inhibiting step may be accomplished, for example, by disabling the power supply associated with driver associated with the line having lower than normal impedance and/or by preventing the printer driver circuit from providing data and/or address signals to the printhead.

19 Claims, 6 Drawing Sheets

THERMAL INK JET PRINTHEAD DRIVER OVERCURRENT PROTECTION SCHEME

BACKGROUND OF THE INVENTION

1. Field of the Invention

The present invention relates to a thermal ink jet recording apparatus employed for recording information in the form of visual images and symbolic characters by means of thermally effecting the ejection of ink droplets onto an ink receiving-/recording media (e.g. sheets of paper and the like). More particularly, the present invention relates to a method and apparatus for detection of low to moderate impedance short circuits on any driven lines of a thermal ink jet printhead.

2. Description of Related Art

Ink jet recording apparatus have several well known advantages. For example, the noise level generated by printing/recording is so low as to be negligible and ordinary sheets of paper may be employed without processing and/or coating special synthetic materials on the surfaces thereof. There exist various kinds of ink jet ejecting methods used in the ink jet recording apparatus and in recent years, some of these methods have been put into practical uses.

Among the various kinds of ink jet ejecting methods, one ink jet ejecting method that has proved not only viable, but reliable and relatively inexpensive is described in U.S. Pat. No. 5,319,389, issued on Jun. 7, 1994 to Ikeda et al. Described in that patent is an ink jet ejecting method which employs kinetic energy for ejecting ink droplets by transferring thermal energy into the ink. In this method a rapid volumetric change occurs in the ink because of liquid to vapor transition of the ink caused by the thermal energy so that an ink droplet is ejected from an ejection outlet formed at the front of a recording head, thereby creating an ink droplet. The ink receiving or recording medium is placed close to the nozzle, and the ejected droplet reaches the surface of the recording medium thus establishing information recording.

A recording or printhead used in the above described ink ejecting method, in general, has the ink ejection outlet for ejecting ink droplets and an ink liquid passage which communicates with the ink ejection outlet which includes an electro-thermal converting element for generating the thermal energy. The electro- thermal converting element includes a resistance layer for heating by applying a voltage between two electrodes in the material. In this kind of a printhead, forces are applied into the ink in the ink liquid passage, which are induced by capillary action, pressure drops or the like, and are balanced so that a meniscus is formed in the liquid passage adjacent the ink ejection outlet. Every time an ink droplet is ejected, by means of the above mentioned balanced forces applied to the ink, ink is drawn into the ink passage and a meniscus is formed again in the ink passage adjacent the ink ejection outlet.

There are numerous difficulties that may occur with an ink jet system such as that heretofore described. For example, the active nozzle heater driver circuit, including the heater, for applying thermal energy to the ink, is often located on an integrated circuit chip (as opposed to discrete components). The active nozzle heater circuits (if field effect transistors) normally have their sources connected to ground on the chip. The ground is conventionally wired through the chip, and small bits of contamination at the wrong place may cause at least a low impedance short or an actual short. Many times in the manufacture of such integrated chips, a layer associated with the heater resistor may be inadvertently connected to ground or punched through for connection to another resistance layer. The increased current through the external line driver results in breakdown or failure of the driver after prolonged operation. Moreover, during connection to the pads of the chips to the external electronic circuitry of the machine, occasionally the TAB bonder machine errs and connects the ground beam to the data line pad on the heater on the chip, causing a data line to ground short circuit. (This kind of short also may occur with address lines.) The result of any of these type manufacturing errors, of course, may result in "blown" line drivers.

Other kinds of shorts which can be disastrous to the data and/or address line drivers include occurrences of electrostatic discharge. Conventionally, ESD protection diodes are provided between each data line and ground pads on the IC chip. If an electrostatic discharge occurs, many times these diodes will short causing a data line to ground short creating an over current condition in the line driver associated with that data line. A similar condition may also occur in address lines.

Conventionally the interconnection between the chip and the external world is through a TAB circuit or tape that connects the data line to the heater chip pads and another pad to ground. The tape or TAB circuitry is coated to inhibit ink that happens to spread under the TAB circuit, from shorting lines on the circuit. Occasionally this coating may be flawed and may include voids. Moreover, ink deposited in a manner to underlie (partially) a TAB circuit, tends to migrate or grow over time between the ground TAB circuit and the data TAB circuit. This occurs because the ink is ionic, and the positive and ground potential will tend to be attractive to the ink. Once a bridge-like contact occurs, a short condition exists and line driver destruction is likely to occur.

While such manufacturing caused defects and shorted conditions should be detected in the chip electrical test, "walk around" by the tester of the defect may occur, or the faults described may be intermittent or occur only after a period of operation (e.g. the ink migration condition mentioned above). Moreover, the chip electrical test acts as a bottleneck to increased production. Therefore, it is advantageous, as will be seen hereinafter, to allow for dynamic testing under usage conditions, which will permit testing in the machine in a manner to inhibit catastrophic breakdowns, especially with respect to driver circuits.

In the machine testing of ink jet printers to protect against short circuits due to ink contamination of high voltage electrostatic plates, is well known. For example, in U.S. Pat. No. 4,171,527 a circuit is disclosed which senses the fouling of an electrostatic ink jet head and causes shutoff of the head and of the associated electronics. Ink fouling is sensed by detecting contamination of the charge electrodes or of the deflection plates by conductive ink. The circuit employs a strobe in conjunction with a comparator which acts as a gate so that testing occurs only upon command. Even though this circuit is highly' useful in testing for ink fouling of high voltage plates with highly conductive ink in electrostatic ink jet printers, it has been discovered that the conditions noted above with respect to thermal ink jets is also conducive to a similar testing with additional advantages due to other types of shorting problems with respect to the drivers for data and address lines by attempting to protect against not only Ink shorts, but other overcurrent situations.

Other patents that deal specifically with the problem are discussed below:

U.S. Pat. No. 4,119,973, issued on Oct. 18, 1978 discloses a fault detection and compensation circuit for ink jet printer wherein the control circuitry monitors the potential of the deflection electrode and if an electrode short substantially persists for a period of time greater than a preselected period, the printer will be disabled and the printing operations will be terminated. See FIGS. 1–4, column 2 lines 10–45 and claims 1–4. Again, the patent deals specifically with highly conductive ink, and electrostatic ink jet printing.

U.S. Pat. No. 4,439,776, issued on Mar. 27, 1984, discloses ink jet charge electrode protection circuitry wherein the operational status of each charge electrode is determined by monitoring either the voltage level of the electrode or the current flowing to the electrode. If the voltage level is below a defined level or the current flow is above a defined level, a fault condition is detected and the charge electrode supply voltage of the ink jet printer is shut down to avoid damage, specifically to the charge electrodes. The protection circuitry is specifically related to charge electrodes and their protection, not drivers and not for a thermal type ink jet printer. See the Abstract and FIGS. 1–5.

U.S. Pat. No. 4,825,102, discloses a MOSFET drive circuit that provides protection against transient voltage breakdown, and specifically for high voltage applications such as vacuum discharge tubes, electroluminescence, electrostatic discharge ink jet printers etc. The patent discloses a circuit which prevents the destruction of complimentary FET's (drive circuits having a P-channel MOS FET and an N-channel MOS FET in a push-pull configuration) even if a supply voltage higher than the on-state withstand voltage of the FET's is applied. (See FIGS. 1–12). No such configurations are necessary or utilized in the present invention.

U.S. Pat. No. 4,841,313, discloses an RF drive network to provide power to an ion deposition print cartridge. (Toner, laser type printer.) The circuit employs feedback to synch and control drive power as well as to bias an amplifier to achieve uniform drive voltage and timing regardless of variations in component characteristics. A fault detector is employed, connected to the drive lines, to detect open (not short) circuit conditions and to inhibit further energization of the drive lines. See FIGS. 1–8 and column 2.

SUMMARY OF THE INVENTION

In view of the above, it is a principal object of the present invention to detect low to moderate impedance short circuits on any driven (driver) lines of a thermal ink jet printhead.

Another object of the present invention is to provide not only detection of low to moderate impedance short circuits on any driven lines of a thermal ink jet printhead, but to also disable further printing to prevent damage to the external (of the head) line printer drivers.

Still another object of the present invention is to provide an indication of a driver line short to aid in troubleshooting if and when a short occurs.

Defined herein is a method of and apparatus for detecting low to moderate impedance short circuits on any driven lines of a thermal ink jet printhead. Upon detection of a driver line short circuit, printing is disabled to prevent damage to the printer driver circuitry. Detection may be done before or during a line of print as long as the testing and print commands are not simultaneous. Shutdown may be accomplished with or without printer control logic intervention.

Other objects and a more complete understanding of the invention may be had by referring to the following description taken in conjunction with the accompanying drawings in which:

BRIEF DESCRIPTION OF THE DRAWING(S)

DESCRIPTION OF THE ILLUSTRATIVE EMBODIMENTS

Background Apparatus

Figures 1A, 1B:
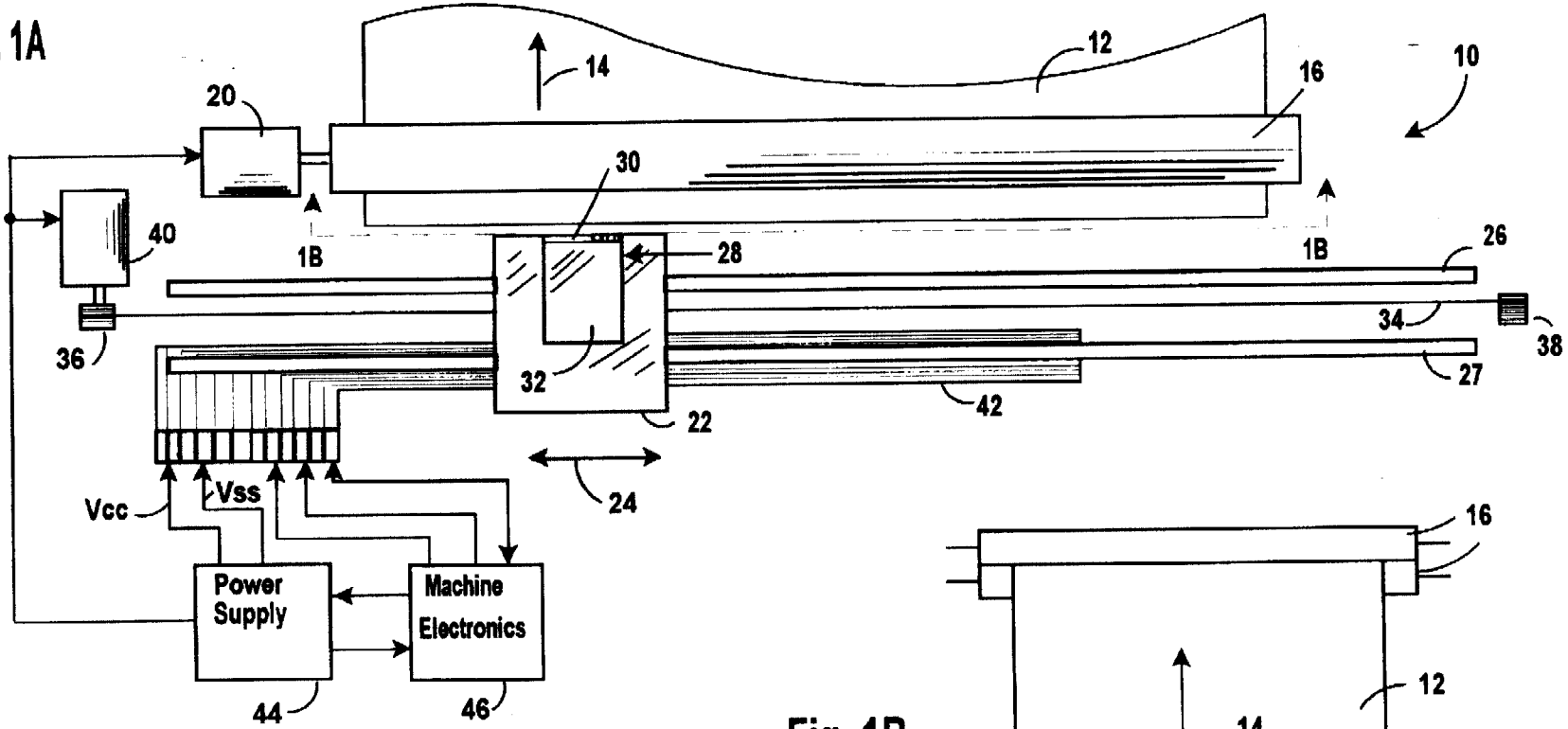
FIG. 1A is a schematic view in plan of a thermal ink jet printer to which the novel method and apparatus of the present invention pertains.
FIG. 1B is a fragmentary, reduced view of a portion of the apparatus illustrated in FIG. 1A, and taken along line 1B—1B of FIG. 1A.

Turning now to the drawings, and particularly FIG. 1A, FIG. 1A shows an embodiment of an ink jet printer 10 to which the present invention is applicable. In FIG. 1A, a print receiving media 12, which is the recording medium made from paper or plastic thin film and the like, is moved in the direction of an arrow 14, being guided by superimposed pairs 16, 18 of sheet feed rollers and under control of medium drive means, in the present instance a drive motor 20.

As shown best in FIG. 1B, roller pairs 16, 18 are spaced apart a sufficient distance to permit passage therebetween of a printhead carrier 22, in close proximity to the print receiving media 12 which extends intermediate the roller pairs 16, 18. As shown by the arrow 24, the carrier 22 is mounted for orthogonal, reciprocatory motion relative to the print receiving media 12. To this end, the carrier 22 is mounted for reciprocation along a pair of guide shafts 26, 27. Mounted on the carrier 22 is a recording head unit comprising, in the present instance, an ink jet printhead 28 including a plurality of individually selectable and actuable nozzles in a nozzle plate portion 30, and a supply of ink in an ink holding tank 32. With this structure the ink ejection nozzles in the nozzle plate 30 of the ink jet printhead 28 confront the print receiving media 12, and ink may be ejected, in the manner heretofore described, by thermally heating the ink in the nozzles, to effect printing on the print receiving media 12.

The reciprocatory or side-to-side motion of the carrier 22 is established by carrier drive means, in the illustrated instance comprising a transmission mechanism including a cable 34 and pulleys 36, 38 winding the wire 34 under control of a carrier drive motor 40. In this manner, the print head 28 may be moved and positioned at designated positions along a path defined by and under control of the carrier drive means and machine electronics 46.

The carrier 22 and the printhead 28 are connected electrically by a flexible cable 42 for supplying power from the power supply 44 and control and data signals from the machine electronics 46.

In the above structure, when printing occurs, simultaneously with a movement of the carrier 22 in the direction of the arrow 24 in FIG. 1A, the electro- thermal converting element, associated with each nozzle, is driven selectively in accordance with recording data so that ink droplets eject from the nozzles and impinge upon the surface of the print receiving media 12, the ink drops forming the recording information on the print receiving media 12.

Background Electrical Scheme

Figure 2:
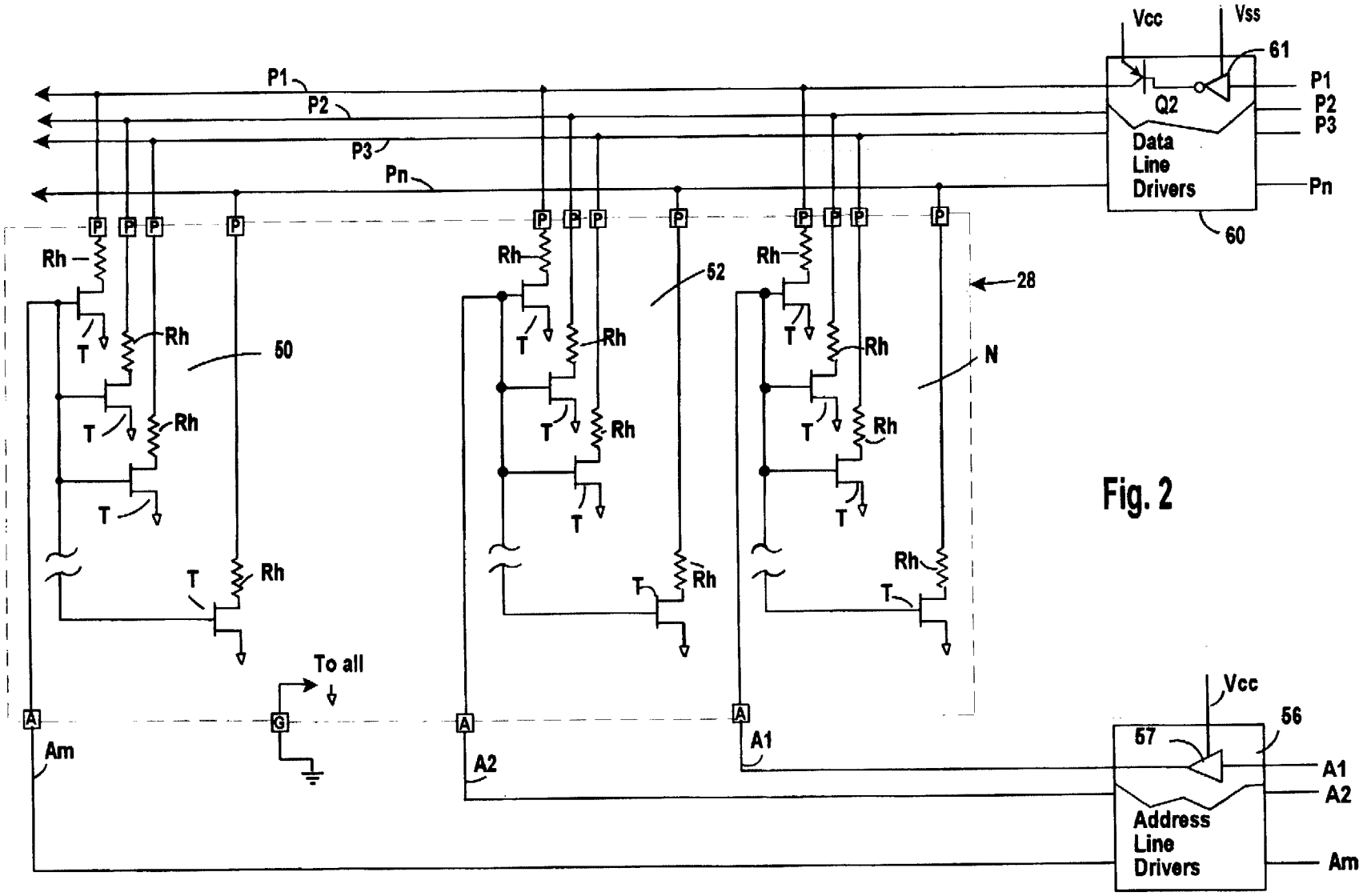
FIG. 2 is a schematic diagram of a typical "row-column" or matrix driver scheme for a thermal ink jet printhead of a thermal ink jet printer, such as illustrated in FIG. 1.

FIG. 2 shows a typical "row-column" or "matrix" driver scheme for the thermal ink jet printhead 28. The nozzles, or ink ejecting outlets in the nozzle plate 30, are normally arranged in groups or banks in columns and/or rows. For example, in FIG. 2, arranged in an integrated circuit on the printhead 28, are a plurality of groups 50, 52, N of nozzle heater drivers, in the present instance field effect transistors "T". While only three such banks are shown, by way of example only, there may be 13 or more banks or groups of nozzles. Each of the FET transistors "T" of each of the groups is associated with a nozzle or ink ejecting outlet in the nozzle plate 30, and each of the FET's includes a heater resistor Rh in the drain of the FET. Each of the sources of the FET transistors T are connected to ground and a ground connection at the "G" pad connects all of the grounds to a machine ground for the ink jet printer 10. The high end of each of the heater resistors Rh of a bank or group is connected to a separate data line input or "P" pad on the chip, while each of the gates of a bank is connected to a single "A" pad to provide a single address line input for each of the banks 50, 52 . . . N.

When an "A" address line A1, A2 . . . Am is driven to a HIGH state, all of the printhead heater resistors Rh of a bank are enabled to be driven by turning ON the associated FET's "T" on the printhead 28. For example, one of a group of address line drivers 56 (each of which may comprise a buffer-amplifier 57), may receive a high input along the address line Am. The high signal is fed through the buffer-amplifier 57 and applied to the gates of each of the FET's "T" in bank 50. An individual heater resistor Rh is turned ON if its particular "P" (data) line is also active. Current is then conducted through the heater resistor Rh locally heating the ink in the nozzle to thereby increase the volume therein and force a drop of ink to be ejected from that nozzle.

A group 60 of data or "P" line drivers is illustrated in FIG. 2. One of the data line (or "P" line) driver circuits, associated with data line P1, is shown in more detail. When a P driver line is to be activated, for example line P1, PNP transistor Q2 is turned ON by the application of a low signal to the base of the transistor Q2. This means that the signal applied to the invertor-amplifier 61 must be a high signal to force its associated data line high. When transistor Q2 is turned on, the power supply voltage, Vcc, is applied to the P1 data line. Power supply voltage Vss is a low power level pre-drive voltage used to turn ON Q2. Often, but not necessarily, Vss is the same voltage as Vcc but operates at a much lower current level and is brought into the driver on a separate line from the power supply 44. Note that application of data to the P1 line applies the Vcc voltage to the top of all heater resistors Rh which are connected thereto, one in each bank of FET's "T". If, for example, only address line Am is high, then only the first FET in bank 50 will be in a conductive mode, heating the ink in its associated nozzle, and thereby causing an ink drop ejection from the nozzle.

Ground is present on the printhead chip itself because the addressed FET's must have their sources connected to ground for operation. This presents the possibility of a short circuit of moderate to low impedance between ground and any driven line on the printhead, i.e. data lines ("P") or address lines ("A"). As has been heretofore described in the section of this specification entitled, "Description of Related Art", short circuits can be caused by many things: manufacture error; stress on a weak printhead; ink in the TAB circuit area etc. For instance consider a short circuit between the ground pad "G" (ground) and the P 1 line in the printhead. This short circuit would cause damaging current to flow in the "P" line driver module when transistor Q2 is turned ON. The present invention prevents this damage from occurring by not allowing at least the associated printhead line drivers, and associated circuitry, to be activated.

The Method and Apparatus of the Present Invention

Figure 3:
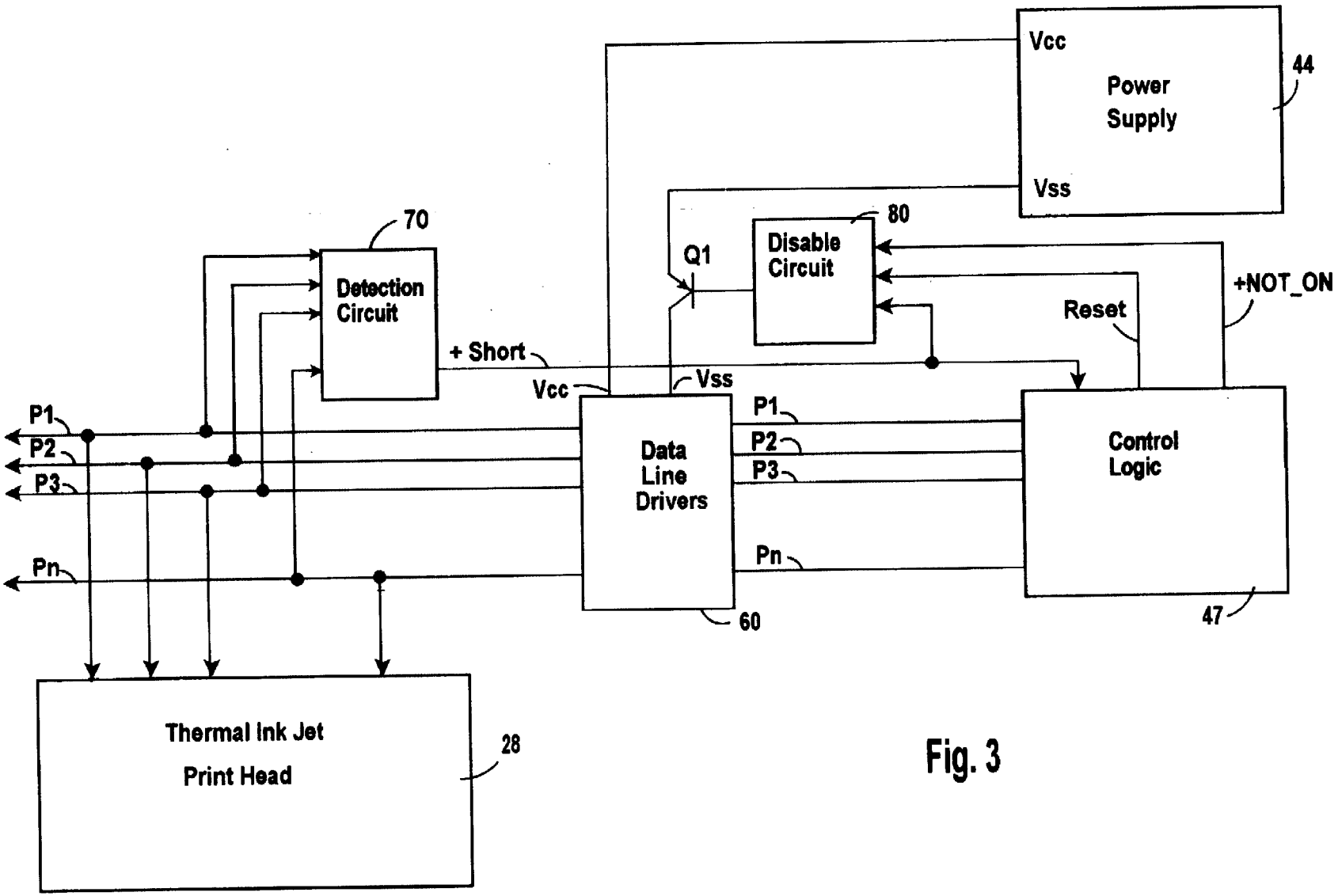
FIG. 3 is a block diagram of an embodiment of the invention where circuitry has been added to that shown in FIG. 2 to protect against data line to ground short circuits.
Figure 6:
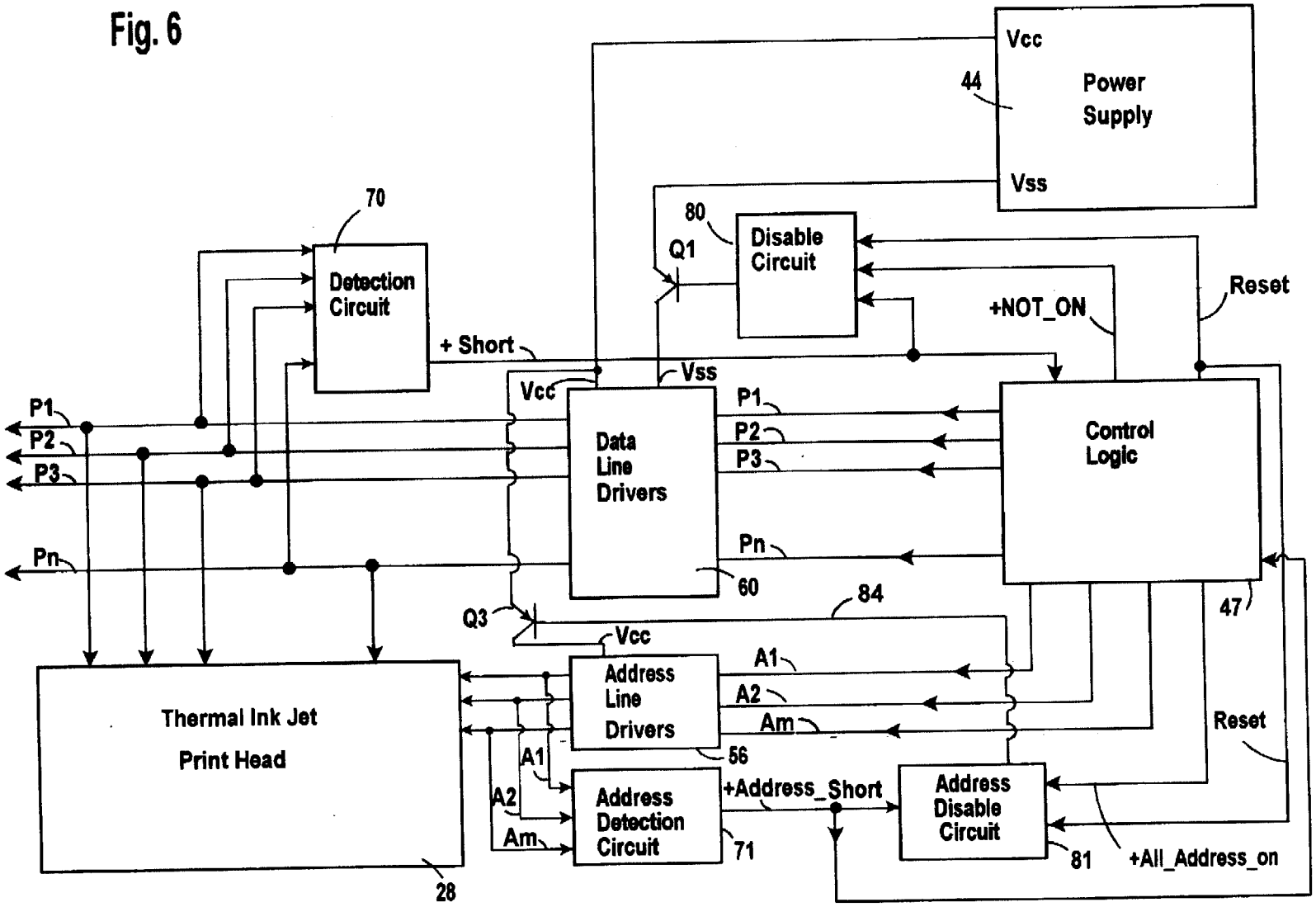
FIG. 6 is a block diagram of an embodiment of the invention where circuitry has been added to that shown in FIG'S. 2 & 3 to protect against both data line and address line to ground short circuits.
Figure 7:
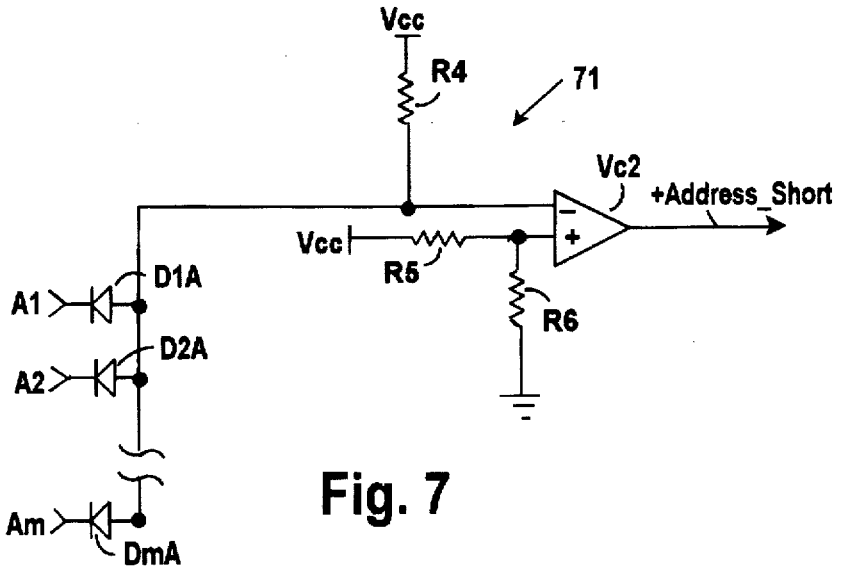
FIG. 7 is a schematic diagram of a short circuit detection circuit which may be employed for detection of address line short circuits, in accordance with the present invention.
Figure 8:
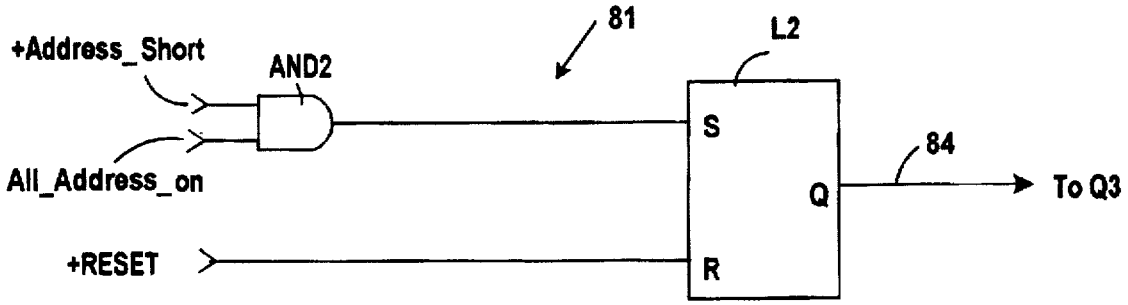
FIG. 8 is a schematic diagram of an address disable circuit which may be employed for disabling printing in the event of the detection of an address line short circuit.

FIG. 3 shows an embodiment of the invention where circuitry has been added to that shown in FIG. 2 to protect against P line (data) to G (ground) short circuits. Similar circuitry designed to protect against "A" line (address) to ground shorts or short circuits on any driven line to ground is best illustrated in FIGS. 6, 7 and 8, and shall be discussed hereinafter. For instance if substrate pre-heat resistors are present or printhead identification circuits are present, these additionally driven lines may be protected in a similar fashion.

In addition to the printhead and P line driver shown in FIG. 2, short circuit detection circuitry 70, disable circuitry 80, printer power supply 44 and printer control logic 47 are shown in FIG. 3. In brief, the operation is as follows: when the short circuit detection circuit 70 detects a P line to ground short, one of three methods, discussed in detail below, may be implemented to inhibit damage to the P line drivers.

1) The short circuit detection circuit 70 brings a +SHORT line output to a logical HIGH level which is fed to the printer control logic 47, which forms part of the machine electronics 46 (FIG. 1). The control logic 47 will then inhibit operation of the printhead, by, for example, preventing further data signals from being sent to the data line drivers 60, thereby preventing P line driver damage, and signal the operator, in a manner to be described hereinafter, that a damaged printhead is suspected.

2) The Short Circuit Detection Circuit 70 brings the +SHORT output to a logical HIGH level which is fed to a disable circuit 80. The disable circuit 80, in a manner which will be described later with reference to FIG. 5, turns OFF transistor Q1 which prevents the firing of the P lines by disabling the power supply voltage Vss to the data line drivers which in turn prevents damage to the line drivers.

3) Both 1) and 2) are implemented. Moreover, in lieu of disabling Vss to the P line driver, Vcc could be similarly disabled in methods 2) and 3).

Figure 4:
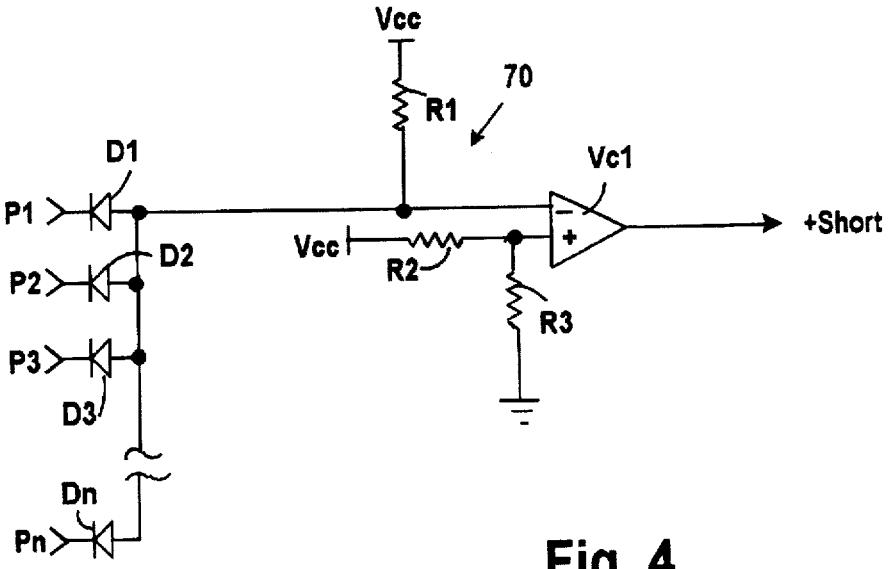
FIG. 4 is a schematic diagram of a short circuit detection circuit which may be employed in accordance with the present invention.

Referring now to FIG. 4, an embodiment of a short circuit detection circuit 70 may be employed in accordance with the present invention. In this embodiment, a plurality of diodes D1, D2, D3, . . . Dn, each diode correspondingly connected to a data line "P", the diodes being arranged in a common anode scheme and pulled up to voltage Vcc through resistor R1. Resistors R2 and R3 are arranged as a voltage divider and provide a DC reference voltage to the positive input of a voltage comparator Vc1. If a short circuit to ground is present on any one of the P lines this will pull the voltage on the negative input of Vc1 below the reference voltage present on the positive input of Vc1. A voltage below the reference voltage at the negative input will drive the inverted output of Vc1 to a logical HIGH state on the +SHORT line, signaling a short circuit is present. If no short circuit is present, the negative input of Vc1 will be pulled up to Vcc by R1. This will force the output of Vc1 to a logical LOW state on the +SHORT line, signaling that it is permissible to print.

It should be understood that the resistance value of R1 is placed high enough so that when the addressed FET's in the printhead are turned ON, the current that flows in R1 is low enough so not to effect normal heater resistor operation when printing.

There are a number of ways in which the control logic 47 may be implemented. For example, the control logic 47 could be either a microprocessor implementation under software or firmware control, or simply combinatorial hardware logic. It should be recognized the high signal on the +SHORT line could be directly input into the control logic 47 and act directly upon the data stream to prevent the input to the drivers with simple NOT_AND combinatorial software or hardware logic. Moreover, the +SHORT signal could be directly employed with a simple latch and hold to prevent the enablement directly of address signals. Both of these ways would, of course, satisfy the requirements of method 1).

Figure 5:
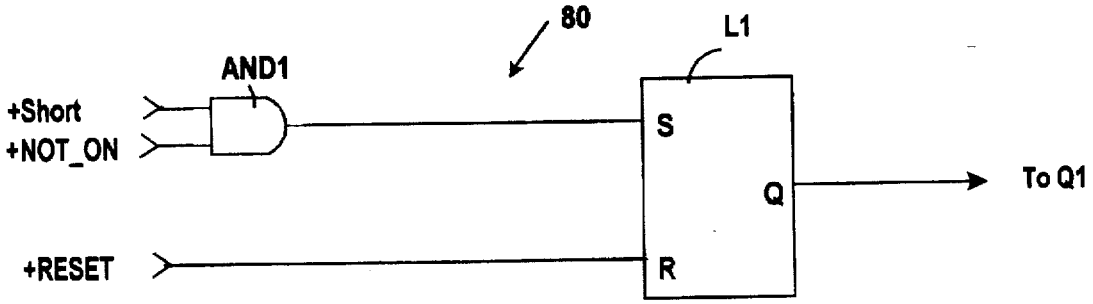
FIG. 5 is a schematic diagram of an embodiment of a disable circuit which may be employed in accordance with the present invention.

In method 2), the drivers 60 themselves may be inhibited to prevent damage thereto. To this end, FIG. 5 shows an embodiment of a disable circuit. The signal on the +SHORT line is from the short circuit detection circuit. The +NOT ON signal (no print or no data signal) is generated by the printer control logic 47. Referring to FIG. 2, when an "A" address line is activated this will enable all the FET's for that address. If any P line is not being fired (turned ON to voltage level Vcc) at that instant, those P lines not fired will be pulled down to ground by the turned ON address FETs. This will show up as a +SHORT on the output of VC 1 for that instant of time. Since the printer control logic knows when it is firing nozzles (i.e. when a particular data line is energized) it can ignore +SHORT indications during nozzle firing instants of time when Method 1) is employed. Recall that in Method 1) the short circuit detection circuit 70 brings a +SHORT line output to a logical HIGH level which is fed to the printer control logic 47. As has been explained, the control logic 47 will then inhibit operation of the printhead, preventing P line driver damage, and signal the operator, in a manner to be described hereinafter, that a short or damaged printhead is suspected.

Alternatively, the printer control logic 47 can generate a low signal on the +NOT_ON line input, which can be used to mask out the +SHORT indication to the disable circuit for methods 2) and 3) during the instants of nozzle fires. Recall that in method 2), the short circuit detection circuit 70 brings the +SHORT output to a logical HIGH level which is fed to the disable circuit 80. The disable circuit 80, as shown in FIG. 5 and as discussed above, turns OFF transistor Q1 which prevents the firing of the P lines which prevents damage to the P line driver. Method 3) is a combination of both methods 1) and 2). Also, it should be noted that instead of disabling Vss to the P line drivers, Vcc could be similarly disabled.

At power ON of the printer, a +RESET signal (FIGS. 3 & 5) resets latch L1's Q output to a LOW logic state turning ON transistor Q1 (see FIG. 3), enabling the P line or data line drivers to operate. If the +SHORT is in a HIGH state, indicating a short circuit, and +NOT ON is also HIGH, indicating a nozzle is not being fired at that instant in time, then the output of AND1 is HIGH, setting L1's Q output to a HIGH logic state. This turns OFF Q1, inhibiting the application of the power supply voltage Vss to the invertor amplifier 61 (FIG. 2), disabling the P line driver so that no damage can occur.

The use of latch L1 in this circuit is optional. Running the output of AND1 to the base of Q1 will also work. The use of the latch will catch and hold marginal or intermittent shorts, which may or may not be considered beneficial.

The limitation of not checking for short circuits during the instant of time that a nozzle is firing does not mean that short circuits cannot be checked during a print line. It just means that they cannot be checked at the actual instant of a nozzle ejecting a drop.

While the data line drivers 60 are more subject to damage in the event of a short circuit, the address lines, even though lower powered, may also be protected in an almost identical manner by the same kind of circuitry. For example, in FIG. 6, the address line drivers 56, with address inputs from the control logic 47, is shown with the address lines extending from the address line drivers 56. Additionally, the output of the address line drivers 56 is also fed to an Address Detection Circuit 71, the signal output +Address_Short being fed to either or both of the Control Logic 47 and the Address Disable Circuit 81, depending upon the chosen method, i.e. 1), 2) or 3).

In the same manner as with the data line driver short detection method 1), the Address Detection Circuit 71 brings a +Address_Short line output signal to a logical HIGH level upon detection of a short, which signal is transmitted to the printer control logic 47. The control logic 47 may then inhibit operation of the printhead, by, for example, preventing further address signals from being sent to the address line drivers 56, thereby preventing address line driver damage, and signal the operator, in a manner to be described hereinafter, that a damaged printhead is suspected.

Turning now to FIG. 7, the detection circuit 71 has diodes D1A, D2A, . . . DmA connected in a common anode form, to pull up resistor R4 and the negative input of comparator Vc2. The anodes of all of the diodes are pulled up to voltage Vcc through resistor R4. As before in FIG. 4, resistors R5 and R6 are arranged as a voltage divider and provide a DC reference voltage to the positive input of the voltage comparator Vc2. Under normal circumstances, if any one of the address lines goes high to enable the heater nozzle drivers (FETs "T") of a particular bank, the negative input to the comparator Vc2 will still remain low because of the low state on the remaining address lines. This means that the inverted output of Vc2, identified as "+Address_Short", will under normal circumstances be high. (Le. current is still drawn through resistor R4, keeping the voltage at the negative input lower than the reference voltage at the positive or reference input of comparator Vc2.) Accordingly, the normal output of comparator Vc2 is high. Thus the method of testing must be altered to determine if a short circuit to ground is present on any one of the address or A lines or is this just the normal condition.

The method of testing the address lines for shorts may be accomplished during a "no print" condition, e.g. at the beginning or end of each line of print, and is very simple. If all of the address lines A1 through Am are turned on simultaneously, (and no data lines are enabled, which would be the situation at the end, or beginning of a printed line), and referring to FIG. 7, the voltage at the negative input of comparator Vc2 would normally rise to Vcc, i.e. higher than the voltage on the reference or+input of Vc2. This would drive the inverted output of the comparator Vc2 low, and thus apply a low signal level on the "+Address_Short" line. Alternatively, if a short occurred on any one of the address lines, with all of the address lines A1 . . . Am asserted simultaneously, current would still flow through resistor R4, maintaining the voltage low at the negative input of the comparator Vc2. This would cause the output on "+Address_Short" to be high, and in accordance with method 1), the Control Logic 47 may then inhibit operation of the printhead, by, for example, preventing further address signals from being sent to the address line drivers 56, thereby preventing address line driver damage.

With regard to the second method 2), the detection of a shorted condition by the Address Detection Circuit 71 brings the "+Address_Short" output to a logical HIGH level which is fed to a disable circuit 81. The disable circuit 81, in a manner which will be described later with reference to FIG. 7, turns OFF transistor Q3 which prevents the firing of the address lines by disabling the power supply voltage Vcc to the address line drivers which in turn prevents damage to the line drivers. To this end, and referring now to FIG. 6, as may be recalled, the output of the comparator Vc2 on the "+Address_Short" line is applied to Address Disable Circuit 81. Turning now to FIG. 8, a first input "+Address_Short" signal is provided to one input of AND gate AND2. The second input to AND gate AND2 is "ALL_Address_On" (see also FIG. 6). Under normal printing circumstances, all addresses will not be on, and therefore the high level input, normally on "+Address_Short" will not be reflected in the ouput of AND gate AND2. Alternatively, if all addresses are high on address lines A1 through Am, and no shorts are present on any address line, the first input "+Address_Short" to AND gate AND2, will be low, and the output of that AND gate, as applied to latch L2, will also be low, despite that fact that the signal of "All_Address_On" is high. If a short occurred on any one of the address lines, current would still flow through resistor R4, maintaining the voltage low at the negative input of the comparator Vc2. This would cause the output on "+Address_Short" to be high, and coincident highs would occur on the inputs of AND gate AND2. A high input to Latch L2 would cause a signal to be sent over line 84 to the base of NPN transistor Q3, inhibiting the application of voltage Vcc to the Address Line Drivers 56, and thereby further printing, until the shorted situation is cleared or corrected.

As before, and referring once again to FIG. 6, a combination of methods 1) and 2) may be employed to insure that printing will not take place if a data or address line is shorted.

In summary, with a short condition on any line (data or address), the lines may be tested for such a condition when there is no print command, and in the case of testing for a shorted address line, the test is accomplished when all of the address lines may safely be energized simultaneously, e.g. at the end or beginning of a print line or even a print operation.

Figure 9:
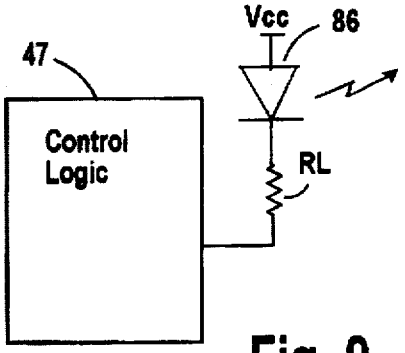
FIG. 9 is a schematic diagram of an indicator to permit the operator to observe that a short and the like has been detected.

It is preferable that if a short condition occurs, that some indication of the error may be given to the machine operator. To this end, and referring now to FIG. 9, the normal error code routines for the print engine, normally contained in the control logic 47, may be modified so that upon a high state on either the +SHORT line in the case of a data line short, or a high state on "+Address_Short" in conjunction with a test period ("All_Address_On"), an LED 86 may be activated in a predetermined and timed interval to indicate the shorted condition. Separate LED's may be employed to indicate whether address line or data line shorts exist, or the predetermined and timed intervals may be coded differently. The actual effected data or address line and in which bank where the short occurs may be found utilizing normal trouble shooting techniques.

Thus the present invention provides not only detection of low to moderate impedance short circuits on any driven lines of a thermal ink jet printhead, but also disables further printing to prevent damage to the printer driver circuitry. Simultaneously therewith, a simple indication of a driver line short is provided to aid in troubleshooting if and when a short does occurs.

Although the invention has been described with a certain degree of particularity, it should be recognized that elements thereof may be altered by person(s) skilled in the art without departing from the spirit and scope of the invention as hereinafter set forth in the following claims.

What is claimed is:

1. A method for detecting a short circuit on a driven line of a thermal ink jet printer and for protecting said printer from said short circuits, said printer including a printhead having a plurality of thermally activated print nozzles having corresponding heater elements, and a plurality of drive lines driven by a line driver, wherein said drive lines supply signals to affect an operation of one or more of said heater elements, said method including the steps of:

applying a potential to energize at least one of said drive lines;

detecting a lower than normal impedance on the at least one of said drive lines so energized; and, inhibiting further operation of said line driver upon detection of said lower than normal impedance on the at least one of said drive lines.

2. The method in accordance with claim 1, wherein said inhibiting step includes the step of disabling a power supply which supplies electrical energy to said line driver.

3. The method in accordance with claim 1, wherein said detection step includes the steps of:

detecting a short circuit on the at least one of said drive lines so energized; and latching the detection of such a short circuit only when a print command is not ON.

4. The method in accordance with claim 1, wherein said inhibiting step includes the step of inhibiting the line driver from supplying signals to the plurality of drive lines.

5. The method in accordance with claim 1, wherein said detection step includes the steps of:

detecting a short circuit on an address line by simultaneous energization of all of a plurality of address lines;

determining if any of the address lines are not capable of being energized as the others due to a short circuit condition; and latching the detection of such a short circuit condition only when a print command is not on.

6. The method in accordance with claim 5, wherein said latching step includes the step of latching the detection of such a short circuit condition only upon determining the presence of a simultaneous energization of said address lines.

7. The method in accordance with claim 4 further comprising the step of disabling the power supply which supplies electrical energy to said line driver in response to the latching of the detection of such a short circuit.

8. The method in accordance with claim 7, further comprising the step of providing an indication of a shorted condition existing on a driven line.

9. The method in accordance with claim 1, further comprising the step of providing an indication of a driven line detected as having a short circuit.

10. An apparatus for protecting a printer from short circuits occurring on a printhead, said printhead having a plurality of thermally activated print nozzles thereon for ejecting ink upon thermal agitation of the ink within an associated nozzle cavity, said printer including a data line driver having an associated plurality of data lines coupled thereto and an address driver having a plurality of address lines coupled thereto, wherein each of said plurality of data lines and plurality of address lines are coupled to a respective one of said nozzles, said apparatus, comprising:

an energizing circuit coupled to one or more lines of said plurality of data lines and plurality of address lines, which energizes said one or more lines;

a detecting circuit coupled to said one or more lines, which detects changes in impedance and generates a detection signal if said one or more lines so energized has a lower than normal impedance; and an inhibiting circuit coupled to said detecting circuit which inhibits operation of one of said data driver and said address driver upon receipt of said detection signal.

11. The apparatus in accordance with claim 10 wherein said inhibiting circuit includes circuitry for disabling a power supply associated with one of said data driver and said address driver.

12. The apparatus in accordance with claim 10 wherein said detecting circuit includes circuitry which detects a short circuit on an energized driver line, and a latch circuit for latching the detection of such a short circuit only when a print command is not on.

13. The apparatus in accordance with claim 11 including an indicator which indicates a shorted condition existing on said one or more lines.

14. An ink jet printer, comprising:

a power supply;

a printhead having a plurality of thermally activated print nozzles thereon for ink ejection upon thermal agitation of the ink within the nozzle;

active element line drivers for driving data and address drive lines, said data and address drive lines being connected to nozzle heater active elements associated with each of said nozzles for effecting current flow through heater elements associated with each of said nozzles upon selection by associated address and data line activation, and said active element line drivers being connected to said power supply;

a first circuit that energizes at least one of a data line and address line associated with at least one thermal ink jet nozzle on said printhead;

a second circuit to detect a lower than normal impedance on the energized line; and, a third circuit that inhibits further energization of at least one of said data and address line drivers.

15. An ink jet printer in accordance with claim 14 further including an indicator that provides an indication of a shorted condition existing on a driven line.

16. An ink jet printer in accordance with claim 14 wherein said third circuit includes a disable circuit that disables said power supply.

17. An ink jet printer in accordance with claim 16 further including a latch circuit that latches upon the detection of such a short circuit only when a print command is not on.

18. An ink jet printer in accordance with claim 14, further including a detection circuit configured to detect a short circuit on an address line by simultaneous energization of all of the address lines, and to detect whether or not any one of the address lines is not capable of being energized to the same level as the other address lines due to a short circuit condition.

19. An ink jet printer in accordance with claim 18, further including a latch circuit that latches upon the detection of such a short circuit condition only upon determining the presence of a simultaneous energization of said address lines.

* * * * *